United States Patent [19]

Kikuchi et al.

[11] Patent Number: 4,869,605

[45] Date of Patent: Sep. 26, 1989

[54] WIRE-DOT PRINTING HEAD WITH ADJUSTABLE SPRING FORCE

[75] Inventors: Hiroshi Kikuchi; Jiro Tanuma; Hideaki Ishimizu; Toshiyuki Asaka, all of Tokyo, Japan

[73] Assignee: Oki Electric Industry Co., Ltd., Tokyo, Japan

[21] Appl. No.: 233,581

[22] Filed: Aug. 18, 1988

[30] Foreign Application Priority Data

Aug. 28, 1987 [JP] Japan ..... 62-130014

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS 4,692,043 9/1987 Ando et al. ..... 400/124
4,792,247 12/1988 Sakaida et al. ..... 400/124

FOREIGN PATENT DOCUMENTS 274117 7/1988 European Pat. Off. ..... 400/124
52360 3/1985 Japan ..... 400/157.2
165258 8/1985 Japan ..... 400/124
123547 6/1986 Japan ..... 101/93.05
163869 7/1986 Japan ..... 400/124
206669 9/1986 Japan ..... 101/93.05

*Primary Examiner*—David A. Wiecking
*Attorney, Agent, or Firm*—Wenderoth, Lind & Ponack

[57] ABSTRACT

A wire-dot printing head having a plurality of printing elements each including an armature fixedly holding a printing wire on the free end thereof, a plate spring fixedly holding the armature on the free end thereof, a permanent magnet for attracting the armature to strain the plate spring so that strain energy is stored in the plate spring, and an electromagnet which cancels the magnetism of the permanent magnet when energized to release the armature so that the armature is returned to the free position thereof by the strain energy of the plate spring to advance the printing wire for printing. The plate spring has an operating lug portion which can be bent in either direction from outside, and an adjusting lug portion which is formed integrally with the operating lug portion and is moved in the opposite direction when the operating lug portion is moved in one direction to adjust the position of the base end of the armature so that the strain energy stored in the plate spring is varied.

1 Claim, 2 Drawing Sheets

WIRE-DOT PRINTING HEAD WITH ADJUSTABLE SPRING FORCE

BACKGROUND OF THE INVENTION

The present invention relates to a structure for a wire-dot printing head, and more specifically, to an adjusting mechanism for adjusting a plate spring for the positional adjustment of an armature.

U.S. Pat. No. 4,225,250 (Segmented Ring Magnet Print Head) discloses a wire-dot printing head having an elastic printing hammer which is held at a rest position during a nonprinting period by the magnetic attraction of a permanent magnet and is released for printing operation.

Such a wire-dot printing head is designated generally as a spring-charged printing head, in which the magnetic flux lines of the permanent magnet forms a closed magnetic circuit. This closed magnetic circuit is formed of the permanent magnet, a base yoke, a base, the core of an electromagnet, an armature fixed to a plate spring, an armature yoke, a spacer, and a magnet yoke. The armature is attracted to the core by the agency of the closed magnetic circuit against the resilient force of the plate spring. In a nonprinting state, the plate spring is strained to store strain energy.

In the printing operation, the exciting coil of the electromagnet is energized by a drive signal to generate a magnetic flux of a polarity reverse to that of the closed magnetic circuit formed by the permanent magnet, and thereby the magnetic flux of the permanent magnet is cancelled to release the armature from the core. Then, the strain energy stored in the plate spring drives the armature to project a print wire fixed to the free end of the armature to press the tip of the print wire against a recording sheet for printing.

In such a conventional printing head, it often occurs that the difference between the attraction of the core and the resilient force (strain energy) of the plate spring, namely, armature holding force, varies. When the variation of the armature holding force is particularly large, the armature releasing timing varies between the armatures, and hence the printing period of the dot printing head is caused to vary, and at the worst, it is impossible to achieve the printing operation under a set driving condition, in which the dot printing head cannot be used. Furthermore, if the dot printing head is usable, prints do not come out clearly or come out in different density degrading print quality.

To eliminate such drawbacks, the assignee of the present invention proposed a wire dot-printing head in U.S. Pat. No. 4,692,043 (Ando et al.). This previously proposed wire dot-printing head has a plate spring having a branching portion near the fixed end thereof, and an adjusting screw having a tip in contact with the branching portion and capable of being operated from outside. The distortion of the plate spring is adjusted by operating the adjusting screw.

However, such an arrangement entails problems that additional parts, namely, the adjusting screws, are necessary for adjusting the distortion of the plate springs, that the adjusting screws must be screwed in place one by one in the manufacturing process, and that the distortion of the plate springs must be adjusted to an optimum distortion by operating the corresponding adjusting screws one by one. Such adjusting work must be repeated a number of times equal to the number of the plate springs, for example, twenty-four times when the dot printing head has twenty-four wires, hence twenty-four plate springs, to form a character by a matrix of twenty-four dots.

SUMMARY OF THE INVENTION

Accordingly, it is an object of the present invention to provide a wire-dot printing head which facilitated the adjustment of the resilient force of the plate spring.

It is another object of the present invention to provide a wire-dot printing head which eliminated adjusting members (adjusting screws) for adjusting the resilient force of the plate springs.

It is a further object of the present invention to provide a wire-dot printing head enabling the adjustment of the resilient force of the plate spring in a comparatively short time.

In a wire-dot printing head according to the present invention, the position of the armature can be carried out while the armature is attracted to a permanent magnet in the nonprinting state by vertically moving an operating lug projecting outward from the plate spring to move an adjusting lug projecting inward from the plate spring for the positional adjustment of the associated armature.

Since the operating lug of the plate spring extends outward, the operating lug can be moved in vertical directions so that the adjusting lug extending inward is moved accordingly for the positional adjustment of the armature. Thus, the adjustment of the resilient force of the plate spring can easily be achieved.

The above and other objects, features and advantages of the present invention will become more apparent from the following description taken in conjunction with the accompanying drawings.

DESCRIPTION OF THE PREFERRED EMBODIMENT

A wire-dot printing head 1 embodying the present invention has a plurality of printing elements, however, since the printing elements are substantially the same in construction, the description of only one of the printing elements will be sufficient.

Figure 1:
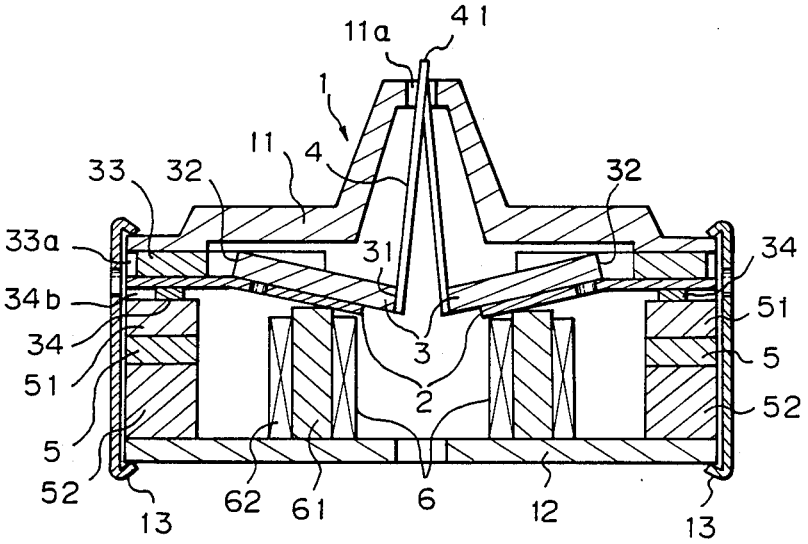
FIG. 1 is a sectional view of a wire-dot printing head in a preferred embodiment according to the present invention.

Referring to FIG. 1 showing the wire-dot printing head 1, disposed between a guide head 11 and a base plate 12 is a plate spring 2 mounted with an armature 3. A print wire 4 is fixed to one end, namely, the free end 31 of the armature 3. The other end, namely, the base end 32, of the armature 3 is received loosely in a groove formed in an armature yoke 33. A base yoke 52, a permanent magnet 5, a magnetic yoke 51 and a spacer 34 are placed one over another in that order on the base plate 12 under the plate spring 2. An electromagnet 6 comprising a core 61 and an exciting coil 62 is disposed below the plate spring 2 on the base plate 12. A plurality of layered arrangements each of those components, namely, the printing elements, are held fixedly between the guide frame 11 and the base plate 12 in a single unit with clamping springs 13 engaging the guide frame 11 and the base plate 12.

When the wire-dot printing head 1 thus constructed is in a nonprinting state, the magnetic flux lines of the permanent magnet 5 form a closed magnetic circuit consisting of the base yoke 52, the base plate 12, the core 61 of the electromagnet 6, the armature 3, the armature yoke 33, the spacer 34, and the magnet yoke 51. The armature 3 is attracted to the core 61 against the resilient force of the plate spring 2 by the magnetic function of the closed magnetic circuit. That is, strain energy is stored in the plate spring 2 while the wire-dot printing head 1 is in a nonprinting state.

During the printing operation, a drive signal is provided to energize the exciting coil 62 of the electromagnet 6 so as to generate magnetic flux of a polarity reverse to that of the magnetic flux of the permanent magnet 5. Thus, the magnetic flux of the permanent magnet 5 is cancelled to release the armature 3 from the core 61. Then, the armature 3 is turned on the base end 32 thereof by the strain energy of the plate spring 2 to advance the printing wire 4 fixed to the free end 31 of the armature 3 along a guide groove 11*a* so that the tip of the printing wire 4 is pressed through an ink ribbon, not shown, against a recording sheet, not shown, for printing a dot.

Figure 2:
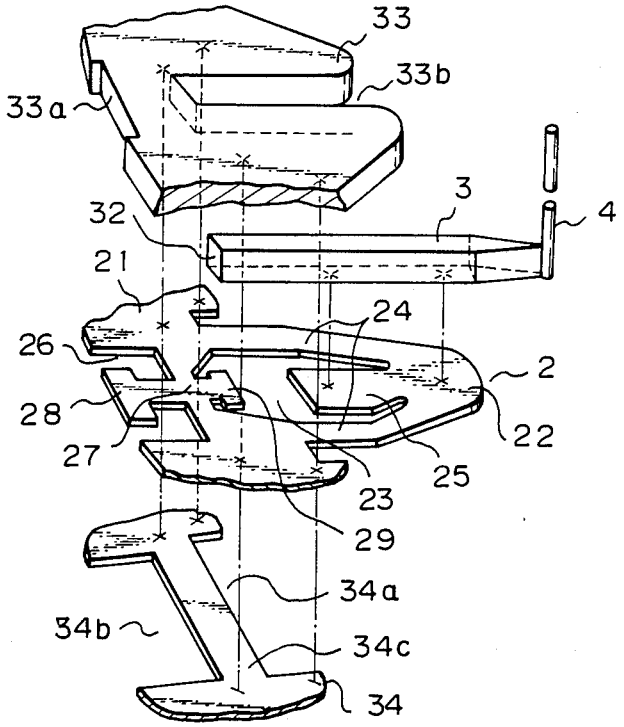
FIG. 2 is an exploded perspective view showing the principal components of the wire-dot printing head of Fig. 1.

FIG. 2 shows the details of the plate spring 2, the armature 3, the printing wire 4, the armature yoke 33 and the spacer 34.

The plate spring 2 is formed substantially in the shape of a disk. The plate spring 2 has a tongue portion 22 extending inward (to the right as viewed in FIG. 2) and having elastic leg portions 24, a punched hole 23 defining the inner edges of the elastic leg portions 24, an adjusting lug portion 29 projecting into the punched hole 23 from the rear portion of the plate spring 2, an armature holding portion 25 for fixedly holding the armature 3, extending outward (to the left as viewed in FIG. 2) into the punched hole 23 from the outer end of the tongue portion 22, recesses 26 formed in the outer end (the left end as viewed in FIG. 2) of the plate spring 2, an operating lug portion 28 projecting outward from the outer end of the plate spring 2, and a neck portion 27 formed between the adjusting lug portion 29 and the operating lug portion 28. The operating lug portion 28 is bent perpendicularly to a plane including the plate spring 2 in one direction to bend the neck portion 27 for plastic deformation, so that the adjusting lug portion 29 is moved in the opposite direction. The upper surface of the adjusting lug portion 29 is in contact with the lower surface of the base end 32 of the armature 3.

The armature yoke 33 placed on the plate spring 2 has a recess 33*a* in the outer side thereof, and a groove 33*b* for loosely receiving the armature 3, substantially in the middle portion thereof. The spacer 34 placed under the plate spring 2 has an inner recess 34*a*, an outer recess 34*b* and a pillow portion 34*c*.

The plate spring 2, the armature 3, the armature yoke 33 and the spacer 34 are joined fixedly together by spot-welding at positions indicated by marks "x" in FIG. 2.

When the wire-dot printing head 1 is assembled, the recess 33*a* of the armature yoke 33, the operating lug portion 28 of the plate spring 2, and the recess 34*b* of the spacer 34 are exposed outside.

Figure 3:
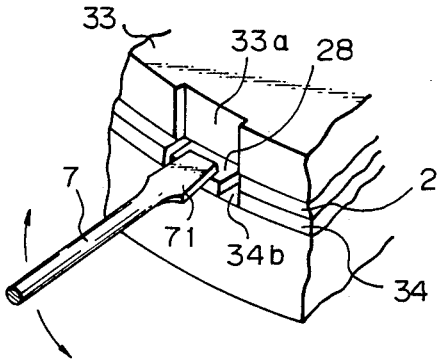
FIG. 3 is a fragmentary perspective view of assistance in explaining the manner of positional adjustment of an armature.

In adjusting the resilience of the plate spring 2, the operating lug portion 28 of the plate spring 2 is bent up or down with the tip 71 of a screw driver 7 inserted in the recess 33*a* or 34*b* as shown in FIG. 3.

Figure 4:
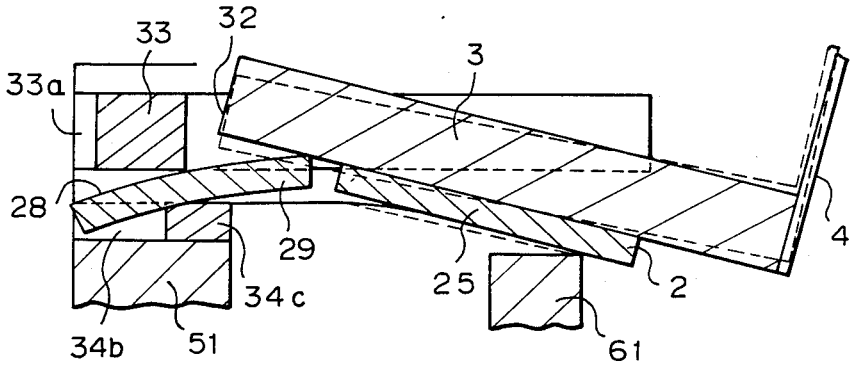
FIG. 4 is a fragmentary sectional view of assistance in explaining the manner of positional adjustment of an armature.

Referring to FIG. 4, in increasing the printing speed of the printing wire 4, the operating lug portion 28 is bent toward the recess 34*b* when the tip 71 of the screw driver 7 is inserted in the recess 33*a*, whereby the adjusting lug portion 29 is turned up on the pillow portion 34*c* to push up the base end 32 of the armature 3 from a position indicated by dotted lines to a position indicated by solid lines. Consequently, the strain energy stored in the plate spring 2 when the armature 3 is attracted to the core 61 of the electromagnet 6 by the permanent magnet 5 is increased, and hence the printing wire 4 advances at an increased printing speed when released from the core 61.

On the other hand, in reducing the printing speed of the printing wire 4, the tip 71 of the screw driver 7 is inserted in the recess 34*b*, whereby the adjusting lug portion 29 is turned down on the pillow portion 34*c* to lower slightly the base end 32 of the armature 3.

Although the invention has been described in its preferred form with a certain degree of particularity, it is to be understood that many variations and changes are possible in the invention without departing from the scope thereof. The scope of the invention should be determined by reference to the claim below.

What is claimed is:

1. A wire-dot printing head comprising:

(a) a plurality of printing elements, each said printing element comprising:

(i) a permanent magnet;

(ii) an electromagnet having a core, said electromagnet generating a magnetic flux capable of cancelling the magnetic flux of said permanent magnet;

(iii) a printing wire having a free end and a printing end; and (iv) an armature having a free end and a base end, said armature fixedly holding said printing wire at said free end thereof, and said armature being attractable to said core of said electromagnet by the magnetism of said permanent magnet; and (b) a plate spring fixedly holding each said armature; capable of being strained for storing strain energy when each armature is attracted to said core of said electromagnet by the magnetism of said permanent magnet, and capable of discharging the stored strain energy when said electromagnet is energized to release said armature from said core for restoring said armature to the free position thereof, said plate spring having an operating lug portion for each said armature, said operating lug portion being operable from the outside of the wire-dot printing head, and an adjusting lug portion integrally attached to each said operating lug portion and contacting said base end of each said armature, said adjusting lug portion being moved in one direction when said operating lug portion is moved in an opposite direction for varying the free position of said base end of said armature for increasing or reducing the strain energy stored in said plate spring when said armature is attracted to said core of said electromagnet by the magnetism of said permanent magnet.

* * * * *